US005528999A

United States Patent [19]

Salmi

[11] Patent Number: 5,528,999

[45] Date of Patent: Jun. 25, 1996

[54] AIR NOZZLE FOR A RECOVERY BOILER

[75] Inventor: Kalle Salmi, Tampere, Finland

[73] Assignee: Tampella Power Oy, Finland

[21] Appl. No.: 383,696

[22] Filed: Feb. 1, 1995

Related U.S. Application Data

[63] Continuation of Ser. No. 6,536, Jan. 21, 1993.

[51] Int. Cl.[6] ..... F23L 5/00

[52] U.S. Cl. ..... 110/182.5; 122/6.6

[58] Field of Search ..... 110/182.5, 297, 110/307, 310; 122/6.5, 6.6; 431/186

[56] References Cited

U.S. PATENT DOCUMENTS

| | | | |
|---|---|---|---|
| 1,165,488 | 12/1915 | Beach et al. | 431/186 |
| 1,662,850 | 3/1928 | Ebner | 110/182.5 |
| 1,821,175 | 9/1931 | Cushing | 110/182.5 |
| 2,112,063 | 3/1938 | Blizard | 110/182.5 |
| 3,015,481 | 1/1962 | Clingensmith | 122/6.6 |
| 3,742,916 | 7/1973 | Wessberg et al. | 122/390 |
| 3,943,861 | 3/1976 | Astrom et al. | 110/182.5 |
| 4,027,604 | 6/1977 | Jansson | 110/182.5 |
| 4,099,471 | 7/1978 | Sander et al. | 110/182.5 |
| 4,940,004 | 7/1990 | Jausen | 110/182.5 |
| 5,044,327 | 9/1991 | Hunt | 122/6.6 |

*Primary Examiner*—Henry A. Bennett
*Assistant Examiner*—William C. Doerrler
*Attorney, Agent, or Firm*—Banner & Allegretti, Ltd.

[57] ABSTRACT

An air nozzle (3) mounted in the wall of a recovery boiler for supplying air from a supply duct (4) into the recovery boiler. The air nozzle (3) comprises a nozzle duct (7) attached to the wall of the recovery boiler and a separate nozzle part (3*a*) insertable into the nozzle duct in its longitudinal direction, air being supplied into the recovery boiler through a duct provided in the nozzle part (3*a*).

9 Claims, 2 Drawing Sheets

Figure 1:
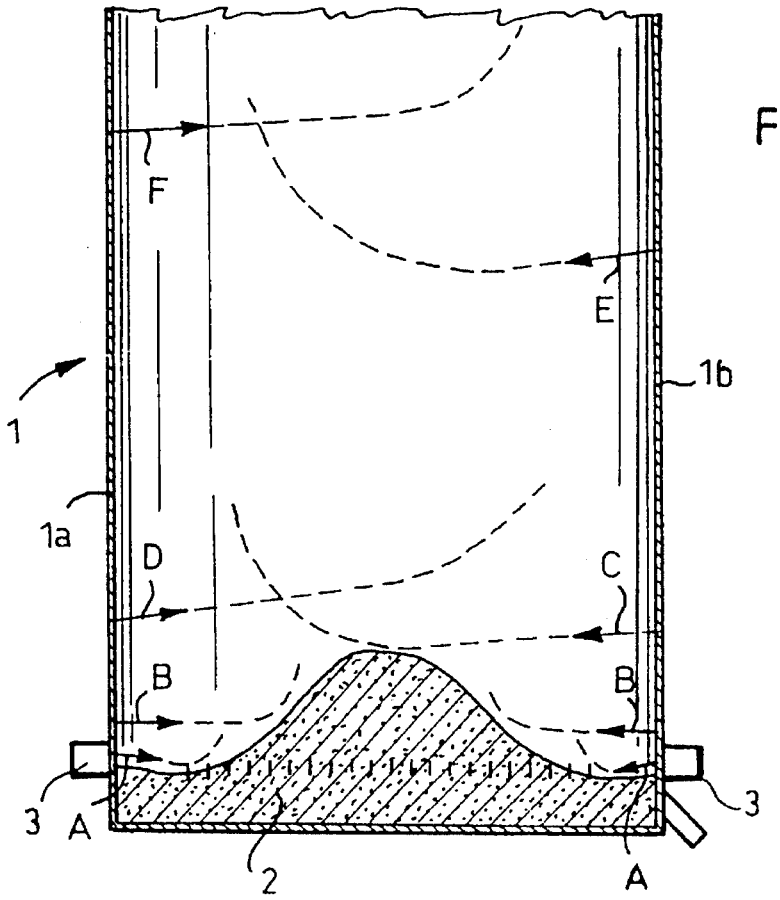

FIG. 3a
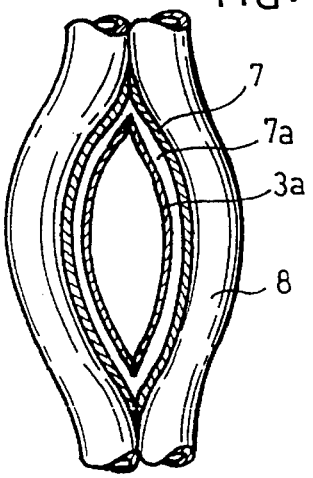
FIG. 3b
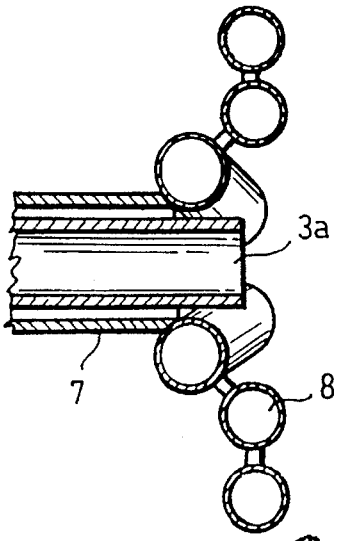
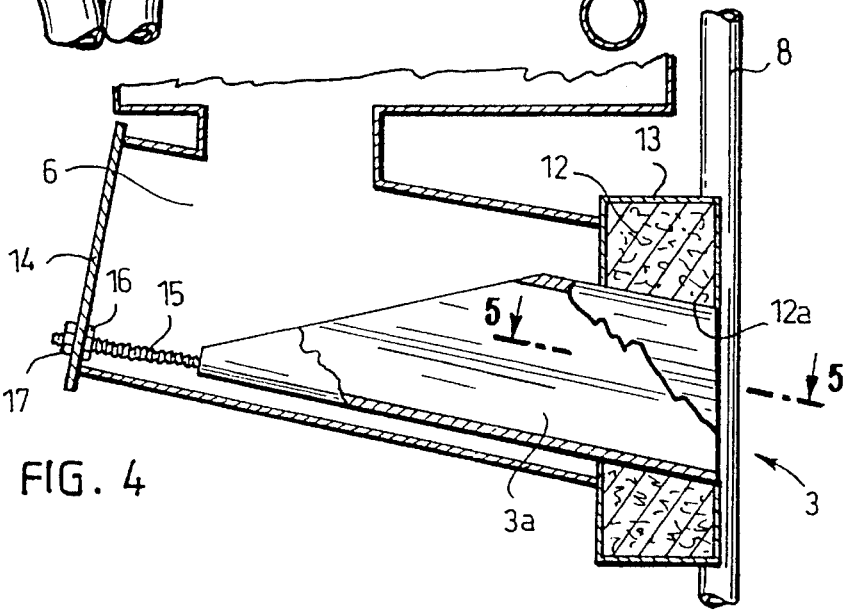
FIG. 4
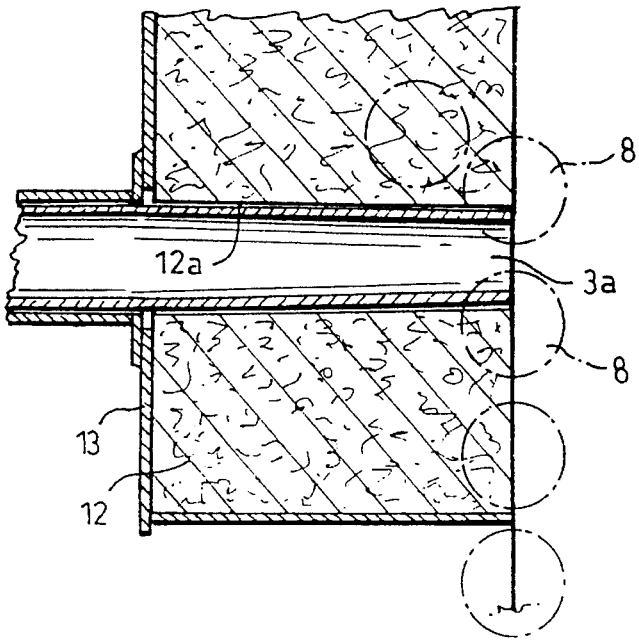
FIG. 5

AIR NOZZLE FOR A RECOVERY BOILER

This application is a continuation of U.S. Ser. No. 08/006,536 filed Jan. 21, 1993.

The invention relates to an air nozzle for a recovery boiler, the air nozzle being mounted gas-tightly in the wall of the recovery boiler and being connected to an air supply duct for supplying air into the recovery boiler.

Air is supplied into the furnace of recovery boilers at several different points during operation, the lowest air nozzles in the furnace wall being called primary air nozzles. They are positioned in level with the surface of the char bed and therefore molten and unburned material from the bed may penetrate into the nozzles. Conditions on the level of the primary air nozzles are also otherwise highly corrosive, which shortens the service life of the nozzles. Furthermore, even great quantities of molten material may unexpectedly flow out of the char bed against the furnace walls, and the penetration of the molten material into the nozzles exerts a high strain on the nozzles. As a result, the nozzles are burned and corrode easily and have to be replaced subsequently.

Existing nozzles are typically made of a tube welded to the pressure casing of the recovery boiler. In some cases, the nozzle is surrounded by a refractory material to prevent damage by smelt leakages. The refractory material is provided either on the edges of the nozzle and below it, or it surrounds the nozzle. A problem therewith is that the nozzle can be replaced only by detaching the entire nozzle structure from the boiler wall. To achieve working conditions in which the detachment of the nozzles from the welds can be done, the shut-down of the boiler is necessary. Another problem is that the detachment of the nozzles may damage the boiler tubing, as a result of which operational disturbances and tube damages may occur after the replacement. If the nozzle is attached to the wall tubes of the furnace by welding, damage to the nozzle usually also results in damages to the furnace wall tubes to which the nozzle is attached.

The object of the present invention is to provide an air nozzle for recovery boilers, which is easy and simple to replace. In the preferred embodiment, the replacement can be made during the operation of the boiler. The air nozzle according to the invention is characterized in that the nozzle comprises a nozzle housing attached substantially gas-tightly to the wall of the recovery boiler and provided with an opening connected to the air supply duct and the furnace of the boiler; and a separate nozzle part arranged to be inserted into the opening of the nozzle housing and similarly to be withdrawn from the opening in its longitudinal direction, air to be supplied into the recovery boiler being passed from the air supply duct through the nozzle part.

The basic idea of the invention is that the air nozzle comprises a nozzle housing attached gas-tightly to the wall of the recovery boiler and connected to an air supply duct, and a separate nozzle part for supplying air therethrough into the boiler is provided in the nozzle housing, the nozzle part being arranged to be sealed to the nozzle housing. In the preferred embodiment, the nozzle part can be withdrawn from the nozzle housing through an opening provided with a detachable cover outside the nozzle housing when it is burned or corroded in the long run, and a new nozzle part can be inserted in place, and this can be done even during the operation of the boiler. The nozzle part may be round or oblong in cross-section, or it may be of some other suitable shape; in view of the sealing, it is, however, preferable that the nozzle part is substantially equal in shape to the opening of the nozzle housing. When the nozzle part is substantially equal in shape to the opening of the nozzle housing, it is easy to seal off; at simplest, it will be very rapidly sealed off automatically when dust penetrates between the nozzle part and the inner surface of the nozzle housing, so that the air flow passes through the nozzle part.

An advantage of the invention is that when the nozzle is constructed as described above, the welds need not be broken to replace the nozzle part nor are there any other work stages that might damage the boiler tubes. Further, nozzle parts of standard shape can be used, and the required installation openings and nozzle housings can be made in the boiler wall simply and easily. In certain cases, the corroding and burning of the nozzle part can be compensated for by pushing the nozzle part a little deeper into the furnace, which increases its service life considerably.

Figure 2:
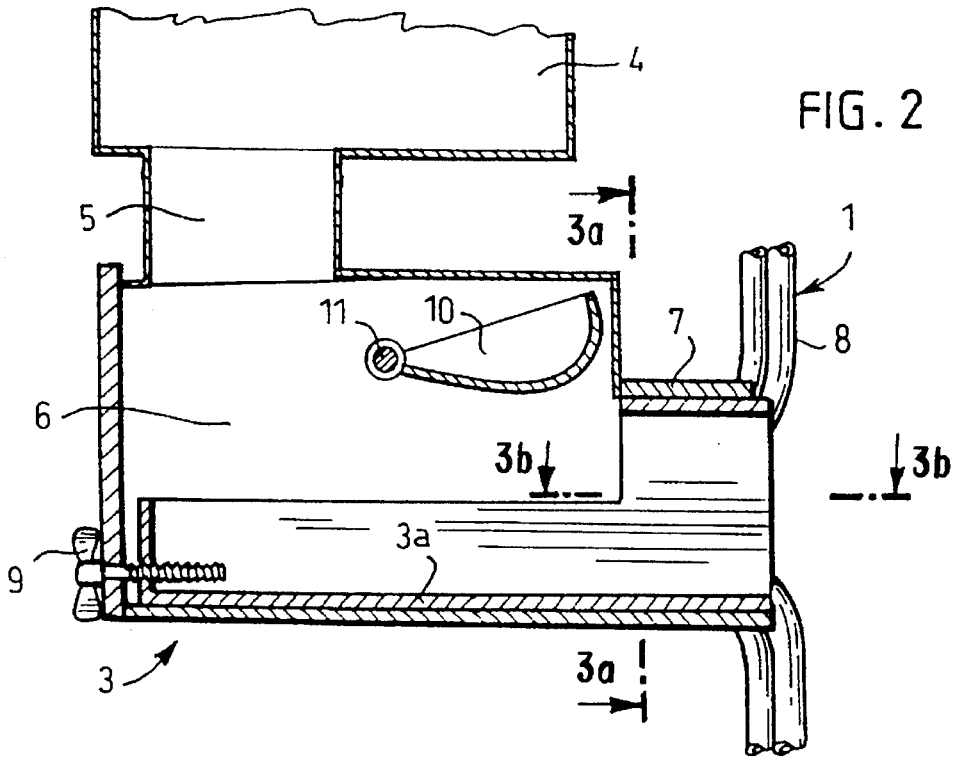

The invention will be described more closely with reference to the attached drawings, in which FIG. 1 is a schematic sectional side view of a furnace of a recovery boiler, illustrating the position of primary air nozzles;

FIG. 2 is a schematic sectional side view of an embodiment of an air nozzle according to the invention;

FIGS. 3*a* and 3*b* illustrate the air nozzle of FIG. 2 as seen from outside the boiler along a section A—A and from above the boiler along a section B—B, respectively;

FIG. 4 is a partial sectional side view of another embodiment of the air nozzle according to the invention; and FIG. 5 is a top view of the embodiment of the air nozzle shown in FIG. 4 along a section C—C shown in FIG. 4.

FIG. 1 illustrates schematically a recovery boiler 1 with a char bed 2 on the bottom of its furnace. To effect burning, air is blown into the boiler 1 at different points according to the situation. The figure shows the air supply points schematically by means of arrows A to F. The present invention is mainly concerned with primary air nozzles shown in the figure as block-like parts indicated by the reference numeral 3. The introduction of air into the recovery boiler and the associated air supply means, such as supply ducts, various air amount regulating means, etc., are well-known and obvious to one skilled in the art, wherefore they will not be described more closely herein. The recovery boiler 1 has walls 1*a* and 1*b* made of water-cooled tubes between which an opening is formed for air nozzles 3 typically attached to the tube wall in such a manner that a gas-tight joint surface is formed between the tube wall and the nozzles.

FIG. 2 shows one embodiment of the air nozzle according to the invention. An air supply duct 4 running along the side of the boiler and passing supply air to the nozzles is connected by means of an interconnecting duct 5 to a nozzle chamber 6 secured by a nozzle housing 7 to the tubes forming the boiler wall 1*a*. The outer edge of the nozzle housing 7 and the boiler tubes 8 form a solid gas-tight joint, and an opening 7*a* is formed centrally in the nozzle housing for a nozzle, i.e. a separate nozzle part 3*a*. The nozzle part 3*a* is substantially oblong in cross-section and has the same cross-sectional shape as the inner surface of the nozzle housing 7 so that the nozzle part 3*a* can be inserted into the opening 7*a* of the nozzle housing 7 from inside the boiler. The nozzle part 3*a* is open on the side of the nozzle chamber 6 to allow the air entering the nozzle chamber 6 to flow through the nozzle part 3*a* into the boiler. The nozzle part 3*a* is dimensioned so that when it is inserted in position, its lower portion extends up to the other end of the nozzle chamber 6, where it is attached to the wall of the nozzle chamber by a bolt 9 passing through the wall. The nozzle chamber 6 further comprises a flap-like air amount regulating means 10 which is turned about a shaft 11 so as to regulate the amount of air supplied into the boiler appropriately in view of the burning process. On inserting the nozzle part 3*a* in position, sealant may be applied around its larger portion, i.e. the portion close to the furnace of the boiler, so as to seal up a gap between the nozzle housing 7 and the nozzle part 3*a* at the initial stage. The material is also elastic, thus compensating for the greater thermal expansion of the nozzle part as compared with the surrounding structures. When the boiler is started, the seal may be burned, but the remaining material and dust accumulating during burning will ensure adequate sealing of the nozzle part 3*a* to the nozzle housing 7.

The structure shown in FIG. 2 is such that the nozzle part 3*a* is replaceable only during boiler shut-downs. The structure can be modified by making the wall of the nozzle chamber 6 on the side of the bolt 9 detachable so that the nozzle part 3*a* can be inserted therethrough into the nozzle housing 7 even during the operation of the boiler.

FIGS. 3*a* and 3*b* show the air nozzle structure of FIG. 2 from outside the boiler along a section A—A and from above the boiler along a section B—B shown in FIG. 2, respectively. As appears from the figures, the nozzle part 3*a* is fitted tightly inside the nozzle housing 7 in the opening 7*a* while the nozzle housing 7 is attached tightly to the tubes 8 by welding on all sides. As seen from the top, the nozzle part 3*a* extends a distance outside the nozzle housing 7, as shown in FIG. 3*b*, so that it will be positioned appropriately in relation to the boiler tubes 8.

FIG. 4 shows another embodiment of the air nozzle according to the invention, where the nozzle part 3*a* is especially designed for replacement during the operation of the boiler. In this embodiment, a duct, i.e. a nozzle housing 12*a* sealed by a sealant 12 is formed in the boiler wall for the nozzle part 3*a*, which is inserted through an opening in the back wall of a casing 13 defining a space for the sealant. On initially installing the nozzle part 3*a*, it is inserted in position and sealed gas-tightly by the sealant. A detachable door 14 is provided at the side of the nozzle chamber 6, and the nozzle part 3*a* is connected to the door by means of an arm 15 and nuts 16 and 17 attached to it so that when the nozzle part 3*a* has been installed, it is longitudinally immovable with respect to the door 14. The door 14, in turn, is fixed in position by means of bolts and nuts or in some other suitable way. After the nozzle part 3*a* has corroded to such an extent that it has to be replaced, the nut 17 is loosened so as to detach the door 14, and so the opening into the nozzle chamber 6 is revealed. Thereafter the nozzle part 3*a* is withdrawn in its longitudinal direction and a new nozzle part 3*a* of substantially similar cross-section is inserted to replace the old one, as shown in the figure. The door 14 is then closed and the nut 17 is tightened to secure the nozzle part 3*a*. Small gaps possibly remaining between the sealant 12 and the nozzle part 3*a* will be sealed off very rapidly by dust and the like, wherefore they can be ignored. If desired, the outside of the original nozzle part 3*a* can be covered with a suitable material within the area of the nozzle housing 12*a* formed by the sealant 12 so as to seal the gap between the nozzle part 3*a* and the sealant, thus facilitating the withdrawal of the nozzle part. Correspondingly, when a new nozzle part 3*a* is inserted in place, it can be covered with a suitable sealant to seal off the gap. This sealant may remain intact or it may be burned by the heat of the boiler while it, however, seals up the space between the sealant 12 and the nozzle part 3*a*. As the sealant is elastic, it compensates for the difference in the thermal expansion between the nozzle part and the nozzle housing due to their different temperatures. The outer surface of the end of the nozzle part may taper towards the boiler to facilitate rapid detachment of the nozzle part; a round nozzle part, for instance, might thus be conical. The end of the nozzle part will also be sealed more easily on inserting the nozzle part into the nozzle housing.

FIG. 5 is a sectional top view of the air nozzle of FIG. 4 along a section C—C. As appears from the figure, a casing 13 surrounds the nozzle part 3*a* and defines a space for the sealant around the nozzle part even on the sides of the nozzle part 3*a*. The sealant 12 in the casing 13 surrounds the nozzle part 3*a*, which tapers from the left to the right in the figure, that is, towards the furnace of the boiler so that it is easier to detach from the sealant 12 for replacement and easier to seal with respect to the sealant 12 on installing a new nozzle part 3*a*.

The invention has been described above and in the drawings by way of example, and it is in no way restricted to these examples. The nozzle part 3*a* may vary widely in shape and structure, provided that it can be simply pushed in position from inside or outside the boiler without any further machining or the like procedures. The sealing of the nozzle part may also be performed in different ways. The nozzle part may vary in cross-section in different applications. The nozzle structure according to the invention can be realized both in individual nozzles and in a so-called register comprising two or more nozzles mounted in the same nozzle chamber. Essential is that each individual air nozzle in the nozzle register is realized as described in the claims.

I claim:

1. An air nozzle for a recovery boiler, said air nozzle being mounted gas-tightly to a wail of said recovery boiler and being connected to an air supply duct for supplying air into said recovery boiler, said air nozzle comprising:

a nozzle housing attached substantially gas-tightly to said wall of said recovery boiler and provided with an opening connected to said air supply duct and to a furnace of said recovery boiler; and a separate nozzle part arranged to be inserted into said opening of said nozzle housing and similarly to be withdrawn from said opening in its longitudinal direction, wherein air to be supplied into said recovery boiler is passed from said air supply duct through said nozzle part, wherein said nozzle can be replaced during normal heating operation of said recovery boiler.

2. An air nozzle according to claim 1, further comprising:

a nozzle chamber provided between said air nozzle and said air supply duct, and fastening means provided at an end of said nozzle part close to said nozzle chamber so as to fix said nozzle part longitudinally immovably with respect to said nozzle chamber.

3. Air nozzle according to claim 2, wherein at least two of said air nozzles are mounted in association with the same said nozzle chamber.

4. An air nozzle according to claim 2, wherein said nozzle chamber comprises an openable and closable opening at the back of said nozzle part in its longitudinal direction so that said nozzle part is withdrawable through said opening from said nozzle housing and similarly insertable into said nozzle housing through said opening.

5. An air nozzle according to claim 1, wherein said nozzle housing is made of a tubular metal section welded to a wall of said recovery boiler.

6. An air nozzle according to claim 1, wherein said nozzle housing is formed by a sealant placed inside a casing attached to a wall of said recovery boiler.

7. An air nozzle according to claim 1, wherein said nozzle part is made of a steel tube cut open at least partially obliquely on a side adjacent said nozzle chamber.

8. An air nozzle according to claim 1, wherein the end of said nozzle part close to a wall of said recovery boiler is substantially equal to said nozzle housing in shape and size.

9. An air nozzle according to claim 1, wherein an outer surface of said nozzle part at an end close to said furnace tapers towards said furnace.

* * * * *